US006886463B2

(12) United States Patent
Inoguchi et al.

(10) Patent No.: US 6,886,463 B2
(45) Date of Patent: May 3, 2005

(54) PRINTING APPARATUS, PRINTING APPARATUS INITIALIZING METHOD, PRINTING APPARATUS ERROR CORRECTING METHOD, PRINTING APPARATUS INITIALIZING PROGRAM, AND PRINTING APPARATUS ERROR CORRECTION PROGRAM

(75) Inventors: Makoto Inoguchi, Nishitokyo (JP); Osamu Honda, Fuchu (JP); Isuke Karaki, Yokohama (JP); Masahiro Kitano, Yokohama (JP)

(73) Assignee: Seiko Epson Corporation (JP)

( * ) Notice: Subject to any disclaimer, the term of this patent is extended or adjusted under 35 U.S.C. 154(b) by 60 days.

(21) Appl. No.: 10/297,196

(22) PCT Filed: Mar. 28, 2002

(86) PCT No.: PCT/JP02/03100

§ 371 (c)(1),
(2), (4) Date: Dec. 9, 2002

(87) PCT Pub. No.: WO02/081226

PCT Pub. Date: Oct. 17, 2002

(65) Prior Publication Data

US 2004/0020390 A1 Feb. 5, 2004

(30) Foreign Application Priority Data

Mar. 28, 2001 (JP) ..... 2001-094093

(51) Int. Cl.[7] ..... B41F 1/54; B41M 1/12; B41J 11/44; B41J 11/58

(52) U.S. Cl. ..... 101/484; 101/129; 400/76; 400/625

(58) Field of Search ..... 101/484, 129; 358/1.12; 347/15, 16; 400/76, 625

(56) References Cited

U.S. PATENT DOCUMENTS

| | | | | |
|---|---|---|---|---|
| 4,930,101 A | 5/1990 | Wong et al. | ..... | 358/1.6 |
| 6,113,208 A | 9/2000 | Benjamin et al. | ..... | 347/7 |
| 6,476,923 B1 * | 11/2002 | Cornell | ..... | 358/1.12 |
| 6,493,098 B1 * | 12/2002 | Cornell | ..... | 358/1.12 |

FOREIGN PATENT DOCUMENTS

| | | | |
|---|---|---|---|
| JP | A 2-273281 | 11/1990 | |
| JP | 02-279344 | 11/1990 | |
| JP | A 3-268984 | 11/1991 | |
| JP | A 8-202509 | 8/1996 | |
| JP | A 10-35057 | 2/1998 | |
| JP | A 2001-58448 | 3/2001 | |
| JP | 2001-264104 | * 9/2001 | ..... G01C/21/16 |
| WO | 98/52762 | 11/1998 | |

* cited by examiner

*Primary Examiner*—Andrew H. Hirshfeld
*Assistant Examiner*—Wasseem H. Hamdan
(74) *Attorney, Agent, or Firm*—Harness, Dickey & Pierce, P.L.C.

(57) ABSTRACT

A printing apparatus can be easily initialized, and can easily know an error correcting method. Upon first power-up, a storage unit stores in the apparatus the initialization item data indicating the items to be initialized, and prints out the stored initialization item data. Since the contents to be initialized are printed out, the operation can be performed according to the contents without reading impossible instruction manual, thereby improving the initializing operation efficiency. Additionally, the storage unit stores the error correcting operation data indicating the operating method for correcting an error when the error occurs in the apparatus, and prints out the stored error correcting operation data. Since the error correcting operation method is printed out, an occurring error can be easily corrected by referring to the output method.

6 Claims, 4 Drawing Sheets

PRINTING APPARATUS, PRINTING APPARATUS INITIALIZING METHOD, PRINTING APPARATUS ERROR CORRECTING METHOD, PRINTING APPARATUS INITIALIZING PROGRAM, AND PRINTING APPARATUS ERROR CORRECTION PROGRAM

TECHNICAL FIELD

The present invention relates to a printing apparatus, a printing apparatus initializing method, and a printing apparatus initializing program, and more specifically to the initialization and error correction for the printing apparatus.

BACKGROUND ART

When a printing apparatus is initialized, all necessary settings are normally made according to the instruction manual, etc. attached to the printing apparatus. When the initialization is completed and an error occurs during the printing process, the error is normally corrected according to the instruction manual.

However, most instruction manuals are not comprehensible. Especially, it is often hard to find a corresponding page. Therefore, it is rather laborious to perform an initializing operation by referring to an instruction manual, etc., thereby considerably reducing the initialization efficiency.

Furthermore, an error may occur after a long time of use. Additionally, an instruction manual may have been lost or discarded, and cannot be referred to. In this case, a sales agent and a service center maybe contacted by phone or facsimile for an error correcting method. However, in this case, the state of the error may not be correctly explained. As a result, an appropriate error correcting method cannot be obtained.

The present invention has been developed to solve the above mentioned problems with the conventional technologies, and aims at providing a printing apparatus, a printing apparatus initializing method, a printing apparatus error correcting method, a printing apparatus initializing program, a printing apparatus error correcting program with which the initializing process can be easily performed, and an error correcting method can be easily obtained.

DISCLOSURE OF INVENTION

A printing apparatus according to the present invention includes: storage means for storing initialization item data indicating an item to be initialized in the apparatus upon first power-up; and data output means for outputting the initialization item data stored in the storage means.

A printing apparatus according to another aspect of the present invention includes: storage means for storing error correcting operation data indicating an operating method for correcting an error when the error occurs in the apparatus; and data output means for outputting the error correcting operation data stored in the storage means.

When the error cannot be corrected according to the contents of the error correcting operation data stored in the storage means, the data output means outputs a facsimile transmission message including the information about the contents of the error.

In the printing apparatus according to present invention the data output means displays data to be output.

The printing apparatus according to claim 5 of the present invention is based on any of claims 1 to 3, and the data output means prints out data to be output.

In another aspect of the present invention, the data output means voice-outputs data to be output.

A printing apparatus according to still another aspect of the present invention includes: a storing step of storing initialization item data indicating an item to be initialized in the apparatus upon first power-up; and a data; output step of outputting the initialization item data stored in the storing step.

In the printing apparatus described above, the data output means prints out data to be output.

Further, the data output means displays data to be output.

Alternatively, in the printing apparatus described above the data to be output may be voice-output.

A printing apparatus error correcting method according to the present invention includes a storing step of storing error correcting operation data indicating an operating method for correcting an error when the error occurs in the apparatus; and a data output step of outputting the error correcting operation data stored in the storing step.

When the error cannot be corrected according to the contents of the error correcting operation data stored in the storing step, a facsimile transmission message including the information about the contents of the error is output in the data output step.

In the error correcting method according to the present invention, the data to be output is printed out in the data output step.

Further, in the printing apparatus error correcting method according to the present invention, the data to be output is displayed in the data output step.

Alternatively, in the printing apparatus error correcting method according, the data to be output may be voice-output in the data output step.

A printing apparatus initializing program according to the present invention includes: a storing step of storing initialization item data indicating an item to be initialized in the apparatus upon first power-up; and a data output step of outputting the initialization item data stored in the storing step.

In the printing apparatus initializing program according to the present invention, the data to be output is printed out in the data output step.

Further, in the printing apparatus initializing program, the data to be output is displayed in the data output step.

Alternatively, in the printing apparatus initializing program, the data to be output may be voice-output in the data output step.

A printing apparatus error correcting program includes: a storing step of storing error correcting operation data indicating an operating method for correcting an error when the error occurs in the apparatus; and a data output step of outputting the error correcting operation data stored in the storing step.

When the error cannot be corrected according to the contents of the error correcting operation data stored in the storing step, a facsimile transmission message including the information about the contents of the error is output in the data output step.

In the printing apparatus error correcting program according to the present invention, the data to be output is printed out in the data output step.

Further, in the printing apparatus error correcting program according to the present invention, the data to be output is displayed in the data output step.

Alternatively, in the printing apparatus error correcting program according to the present invention, the data to be output may be voice-output in the data output step.

BEST MODE FOR CARRYING OUT THE INVENTION

An embodiment of the present invention is described below by referring to the attached drawings.

Figure 1:
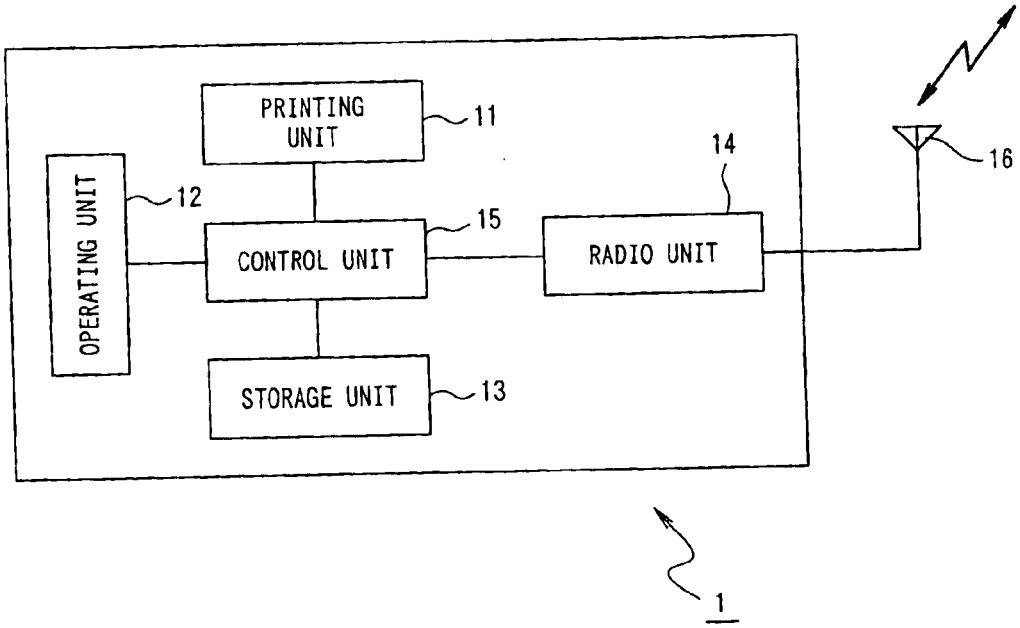
FIG. 1 is a block diagram showing an embodiment of the printing apparatus according to the present invention.

FIG. 1 is a block diagram showing an embodiment of the printing apparatus according to the present invention. As shown in FIG. 1, a printing apparatus 1 according to the present embodiment comprises: a printing unit 11 for printout onto printing paper, etc. not shown in the attached drawings; an operating unit 12 comprising various switches, etc.; a storage unit 13 for storing setting contents, etc. described later; a radio unit 14 for functioning an interface with external units; and a control unit 15 for controlling each of the units. In this embodiment, the printing apparatus for printing data received through an antenna 16 is described. However, it is obvious that the present invention can be applied to a printing apparatus connected to a cable network, a printing apparatus not connected to a network but to a single computer, etc.

The operations of the printing apparatus with the above mentioned configuration is described below by referring to FIGS. 2 and 3.

Figure 2:
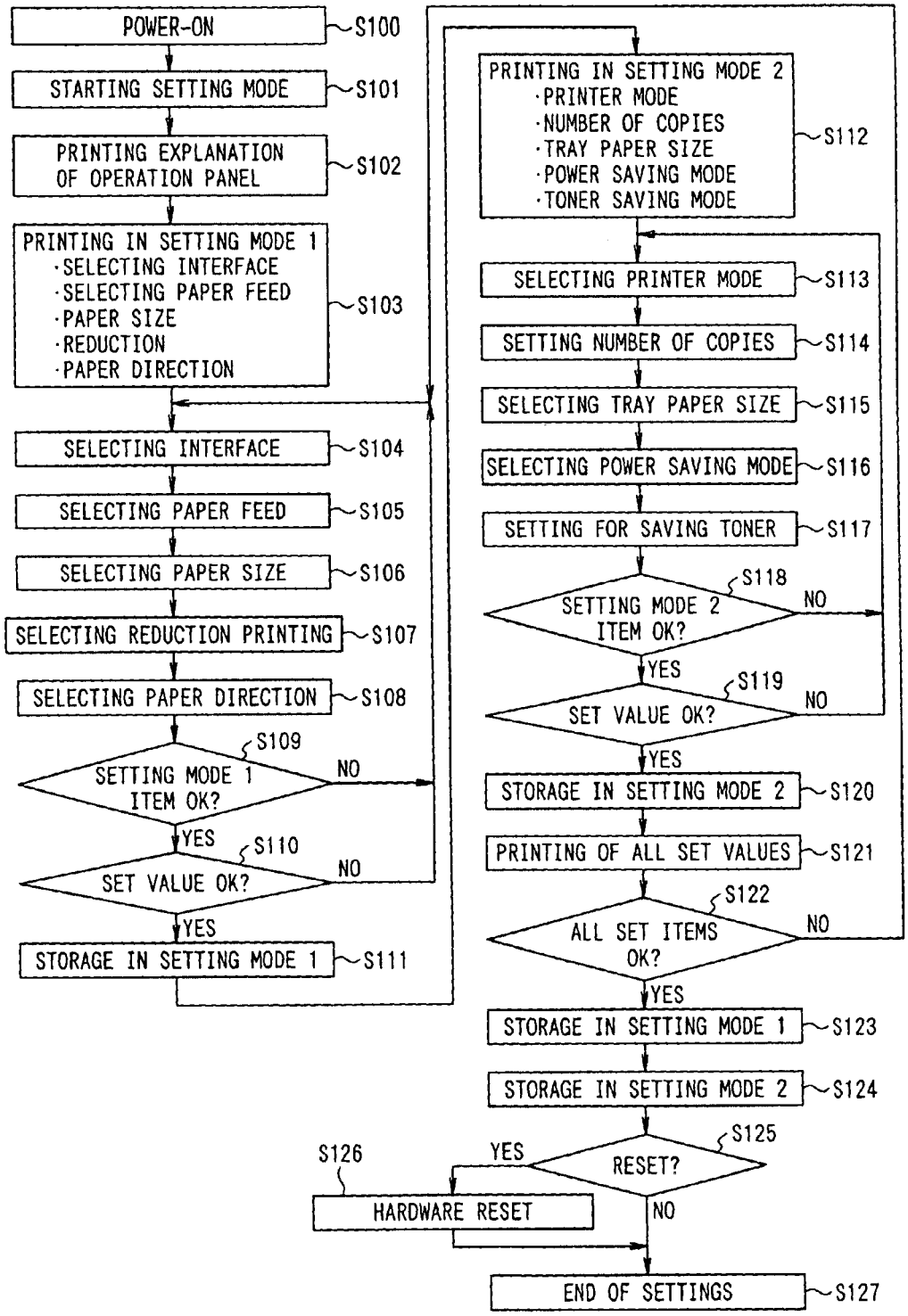
FIG. 2 is a flowchart of the initializing operation procedure of the printing apparatus shown in FIG. 1.

FIG. 2 is a flowchart of the procedure of the initializing operation of the printing apparatus according to the present embodiment. In FIG. 2, after setting the printing apparatus and power is turned on (step S100), a setting mode is started (step S101). Then, a comment about an operation panel is first printed (step S102). The comment describes, for example, the meanings of a switch in the operating unit but not shown in the attached drawings, and the operation method, etc.

Then, the item in the setting mode 1 is printed (step S103). In this case, selection of an interface, selection of paper feed, paper size, possibility of reduction printing, and the direction of paper are printed out (step S103). Each of the above mentioned items are set by a user by referring to the contents of printout. That is, the settings of selecting an interface (step S104), selecting feed paper (step S105), paper size (step S106), possibility of reduction printing (step S107), and the direction of paper (step S108) are sequentially performed.

When the setting operation is completed for each item in the above mentioned setting mode 1, it is checked whether or not each item has been set (step S109). If there are unset items, the setting operations are performed again (step S109→S104 . . . ). When the settings are completed on all items, it is checked whether or not there are problems with the set values (step S109→S110). If there are problems with the set values, then the setting operations are performed again (step S109→S104 . . . ).

If there are no problems with the set values, then the setting contents in the setting mode 1 are stored by the user operating a confirmation button, etc. (step S110→step S111) Then, the items in the setting mode 2 are printed (step S112) In this case, the settings are made for the printer mode (step S113), the number of copies (step S114), the tray paper size (step S115), the power saving mode (step S116), and the toner saving setting (step S117).

When the setting operation is completed for each item in the above mentioned setting mode 2, it is checked whether or not each item has been set (step S118). If there are unset items, the setting operations are performed again (step S118→S113 . . . ). When the settings are completed on all items, it is checked whether or not there are problems with the set values themselves (step S118→S119). If there are problems with the set values, then the setting operations are performed again (step S119→S113).

If there are no problems with the set values, then the setting contents in the setting mode 2 are stored by the user operating a confirmation button, etc. (step S119→step S120) Then, the contents of all set values are printed (step S121). If the user confirms the setting contents, and there are no problems with any set values, then the user operates a confirmation button, etc. In the operation, the setting mode 1 is saved (step S123), and the setting mode 2 is saved (step S124). On the other hand, if there is a problem with a setting item, control is returned to step S104, and the setting operation is performed again (step S122→S104).

Finally, when the processes are reset, a hardware reset is performed, thereby terminating the setting operation (step S125→S126→S127). If they are not reset, the setting operation terminates (step S125→S127).

As described above, the user can perform the initializing operation while checking the printed contents. At this time, it is not necessary for the user to refer to the instruction manual with the operation efficiency improved. In the above mentioned example, the settings are made in two setting modes 1 and 2, but the settings can be made separately in a larger number of setting modes. Furthermore, it is not necessary to use a plurality of modes. That is, the user can select his or her own efficient setting operation.

Figure 3:
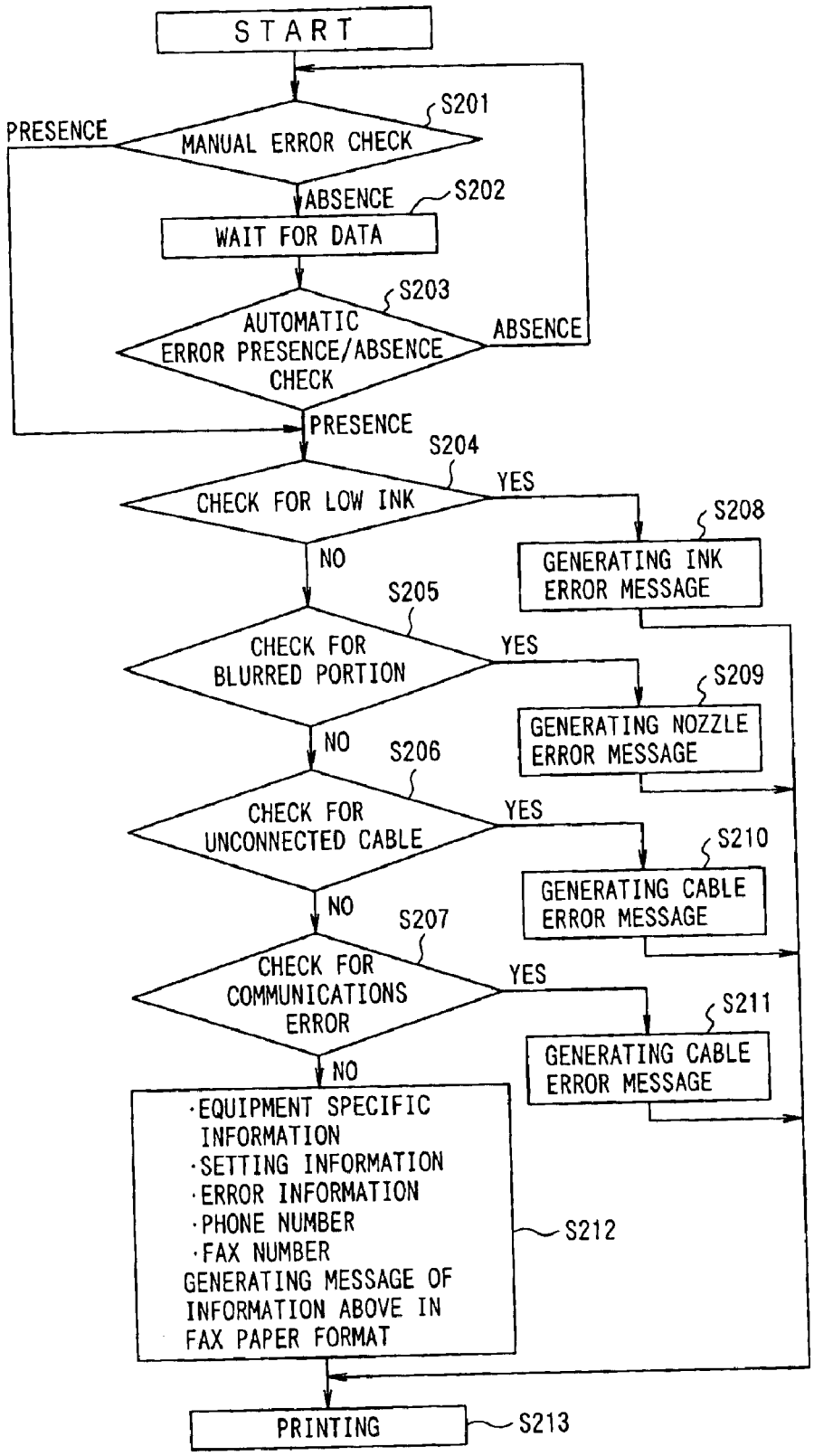
FIG. 3 is a flowchart of the error correcting operation procedure of the printing apparatus shown in FIG. 1.

FIG. 3 is a flowchart of the error correcting operation procedure of the printing apparatus according to the present embodiment. In FIG. 3, if an instruction to manually check an error has not been issued to the user, the printing apparatus waits for data, and performs a printing operation (step S201→S202). If it automatically checks the presence/absence of an error, and there is no error, then the above mentioned operations are repeated (step S203→S201 . . . ).

If there is an instruction to manually check an error issued to the user in step S201, or if the occurrence of an error is automatically checked in step S203, then control is passed to the following error process. In the error process, in the present embodiment, it is sequentially checked whether or not: the ink is getting low (step S204); there is a blurred portion in a printed result (step S205); the cable has not been connected (step S206); and a communications error has occurred (step S207).

If the ink is getting low as a result of the check, then an ink error message is generated (step S204→S208). If there is a blurred portion, then a nozzle error message is generated (step S205→S209). If the cable has not been connected, then a cable error message is generated (step S206→S210). If a communications error has occurred, then a cable error message is generated (step S207→step S211). In case of any of the above mentioned errors, the corresponding error message is printed, thereby terminating the process (step S213). The user can perform an error correcting operation by referring to the contents of the printed error message. At this time, an error can be corrected without reading the instruction manual.

On the other hand, if an error does not correspond to any of the above mentioned errors, then a message including equipment specific information, setting information about initialization contents, error information, a phone number, a facsimile number, etc. is generated (step S212). In this case, a message is generated in the format of facsimile paper including the above mentioned information. The process terminates after printing the generated message (step S213) The user can receives an appropriate process from the service center by either transmitting by facsimile the printed error message, or orally explaining the printed contents through contact by dialing the printed phone number.

Figure 4:
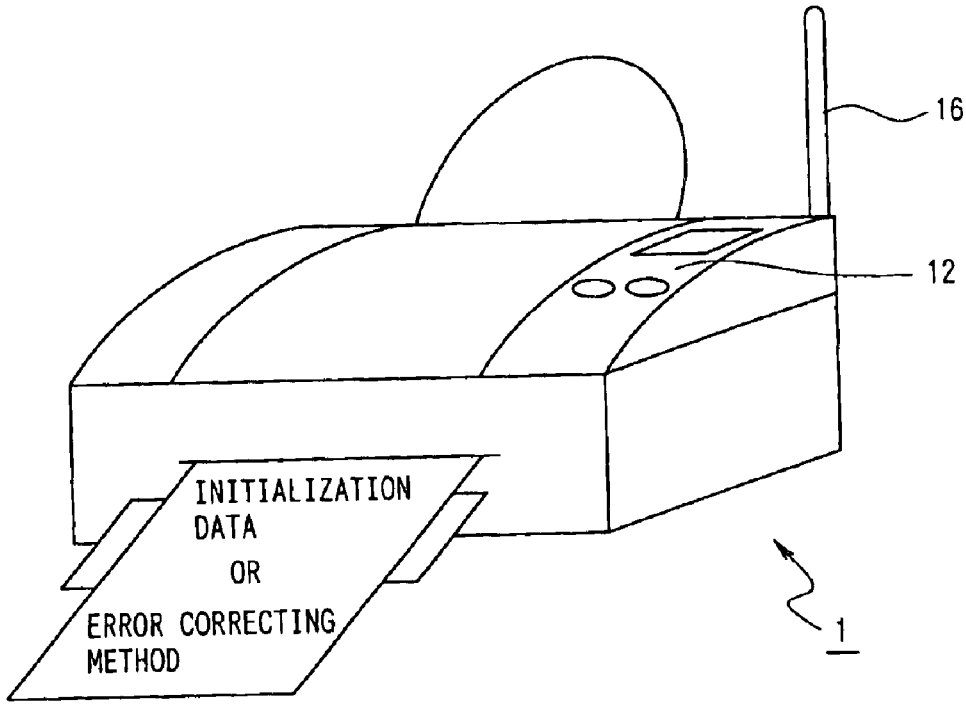
FIG. 4 shows the outline of the printout operation of the printing apparatus according to the present invention.

By the above mentioned operations, the printout operation is performed as shown in FIG. 4. In FIG. 4, the printing apparatus 1 prints out the necessary information as described above, that is, the information about the initialization data and an error correcting method. In FIG. 4, the printing apparatus 1 is provided with the antenna 16 and the operating unit 12.

However, in the examples shown in FIGS. 2 and 3, necessary information is printed out. Other than the printout process, an initialization item can be displayed on the indicator of a liquid display unit, etc., or voice-output. In this case, a display unit, a speech synthesis circuit, a speaker, etc. can be provided as means for outputting the initialization item data stored in the storage unit 13. Thus, the initialization can be performed without printing data onto paper, etc. Furthermore, the printout can be set in principle, and can be replaced with the display on the display unit or the voice-output only when the printout cannot be performed due to an error such as an out-of-paper error, a paper jam error, etc.

The explanation above also holds true with the error correcting operation data. That is, a display unit, a speech synthesis circuit, a speaker, etc. are provided as means for outputting the error correcting operation data stored in the storage unit 13 so that the error correcting operation data can be displayed or voice-output. Thus, an error can be easily corrected without printout on to paper, etc., and a notification of the state of the error can be correctly provided for a service center, etc., thereby avoiding the out-of-paper error.

In addition to applying the present invention to a printing apparatus as an output device of a computer, etc., the present invention can also be applied to the printing apparatus of a copying machine, a facsimile transmission/reception device, etc.

In the above mentioned printing apparatus, the following method is realized. That is, in the operation shown in FIG. 2, the printing apparatus initializing method including a storing step of storing initialization item data indicating an item to be initialized in the apparatus upon first power-up, and a data output step of outputting the initialization item data stored in the storing step is realized. That is, since the contents to be initialized is output, it is not necessary to read impossible instruction manual if the necessary operation is performed according to the output contents, thereby improving the efficiency of the initializing operation.

In the operation shown in FIG. 3, the printing apparatus error correcting method including a storing step of storing error correcting operation data indicating an operating method for correcting an error when the error occurs in the apparatus, and a data output step of outputting the error correcting operation data stored in the storing step is realized. That is, since an error correcting operation method is output, the occurring error can be easily corrected by referring to the method.

Then, when the error cannot be corrected according to the contents of the error correcting operation data stored in the storing step, a facsimile transmission message including the information about the contents of the error is output. Thus, the notification of the status of an error which cannot be easily corrected can be correctly provided for the service center, etc. Furthermore, by the printout process, the initialization can be performed without reading the instruction manual, and the error can be corrected.

Furthermore, if the program for realizing the operations shown in FIGS. 2 and 3 is prepared and a computer is controlled using the program, then the operations similar to those described above can be obviously performed. The storage medium can be the storage unit 13 shown in FIG. 1, or any other various storage media such as semiconductor memory, a magnetic disk, an optical disk, etc., not shown in FIG. 1.

The explanation above relates to a specific embodiment of the present invention, and various modifications and changes may be made to those skilled in the art without departing from the true spirit and scope of the invention as defined by the claims thereof.

INDUSTRIAL APPLICABILITY

As described above, the present invention has the effect of easily initializing a printing apparatus by outputting the contents to be initialized and performing an operation according to the output contents without reading an impossible instruction manual. Furthermore, by outputting an error correcting operation method, and by referring to the output method, an occurring error can be easily corrected without reading an impossible instruction manual. Furthermore, when the occurring error cannot be corrected according to the contents of the stored error correcting operation data, a notification of the status of an error which cannot be easily corrected can be reported for a service center, etc. by outputting a facsimile transmission message including the information about the contents of the error. Additionally, by printing out the error correcting operation data, etc., the initialization can be performed without reading an instruction manual, and the error can be corrected.

What is claimed is:

1. A printing apparatus initializing method, comprising:

storing initialization item data indicating an item to be initialized in the apparatus upon first power-up;

outputting the initialization item data stored in said storing step;

performing a first selling operation;

storing a plurality of settings selected during the first setting operation;

performing a second setting operation;

storing another plurality of setting selected during the second setting operation;

performing a hardware reset to terminate the first and second setting operations; wherein data to be output is voice-output in said outputting step.

2. The printing apparatus initializing method according to claim 1, characterized in that data to be output is printed out in said outputting step.

3. The printing apparatus initializing method according to claim 1, characterized in that data to be output is displayed in said outputting step.

4. A printing apparatus initializing program, comprising:

storing initialization item data indicating an item to be initialized in the apparatus upon first power-up; and outputting the initialization item data stored in said storing step;

performing a first setting operation;

storing a plurality of settings selected during the first setting operation;

performing a second setting operation;

storing another plurality of settings selected during the second setting operation;

performing a hardware reset to terminate the first and second setting operations; wherein data to be output is voice-output in said outputting step.

5. The printing apparatus initializing program according to claim 4, characterized in that data to be output is printed out in said outputting step.

6. The printing apparatus initializing program according to claim 4, characterized in that data to be output is displayed in said outputting step.

* * * * *